United States Patent [19]

Tobias et al.

[11] Patent Number: 4,556,860

[45] Date of Patent: Dec. 3, 1985

[54] CONDUCTIVE POLYMERS

[75] Inventors: Russell H. Tobias, Reynoldsburg; David A. Hutchings, Newark, both of Ohio

[73] Assignee: Owens-Corning Fiberglas Corporation, Toledo, Ohio

[21] Appl. No.: 572,035

[22] Filed: Jan. 19, 1984

[51] Int. Cl.[4] ..... H01C 7/10

[52] U.S. Cl. ..... 338/22 SD; 338/22 R; 338/255; 338/234; 174/17.05; 174/17.08; 174/126 R

[58] Field of Search ..... 338/234, 255, 22 R, 338/22 SD; 174/17.05, 17.08, 126 R; 29/825, 855

[56] References Cited

U.S. PATENT DOCUMENTS 4,315,237 2/1982 Middleman et al. ..... 338/22 R

FOREIGN PATENT DOCUMENTS 1166528 10/1969 United Kingdom ..... 338/255

OTHER PUBLICATIONS

Deits et al., "Stability and Stabilization of Polyacetylene, Polyphenylacetylene, and Acetylene/Phenylacetylene Copolymers", Synthetic Metals No. (4), 1982, pp. 199–210.

"New Plastics That Carry Electricity" *Newsweek* Jun. 18, 1979, pp. 77–78.

*Primary Examiner*—C. L. Albritton
*Assistant Examiner*—M. M. Lateef
*Attorney, Agent, or Firm*—Ronald C. Hudgens; Robert F. Rywalski; F. Dean Thomson

[57] ABSTRACT

Method and apparatus for producing an electrical conductor are provided comprising a doped polymeric material and an encasement means substantially impermeable to the dopant, the encasement means having matching surfaces in contact with the polymeric material to reduce the loss of dopant and an inert gas to occupy any voids between the surfaces.

9 Claims, 3 Drawing Figures

CONDUCTIVE POLYMERS

BACKGROUND OF THE INVENTION

This invention relates to conductive polymers and their encasements.

In one of its more specific aspects, this invention relates to encased conductive polymeric materials having prolonged conductivities.

The use of electrically conducting organic polymeric materials, particularly in film form, is well known. Such materials usually comprise a conjugated polymer which is dopable to an electrically conductive state. While such materials are recognized as useful in carrying electrical currents, their use has been limited due to factors related to the degradation of the electrical conductivity, regardless of the chemical doping techniques employed.

This invention is directed to such polymeric films and attendant encasements, the combination having a slower electrical conductivity degradation rate than heretofore attained.

STATEMENT OF THE INVENTION

According to this invention, there is provided a method of producing an electrical conductor which comprises encasing at least one electrically conducting polymeric material within an encasement comprising substantially planular surfaces in substantially contact relationship, extending electrical conducting means between said material and the exterior of said encasement and filling the open space of the encasement with an inert gas and sealing the encasement.

Also, according to this invention, there is provided an electrical conductor comprising at least one electrically conducting polymeric material positioned within an encasement comprising two substantially planular surfaces in contact relationship, electrical conductors extending from the polymeric material to the exterior of the encasement, the encasement free space being filled with an inert gas.

In the preferred embodiment of the invention, the encasement will comprise sheets of electrically nonconducting material such as polymeric films, mica and the like, but preferably glass.

In the preferred embodiment, the encasement will be filled to atmospheric pressure, 760 mm Hg, with an inert gas such as nitrogen, argon, or helium.

DETAILED DESCRIPTION OF THE INVENTION

Figure 1:
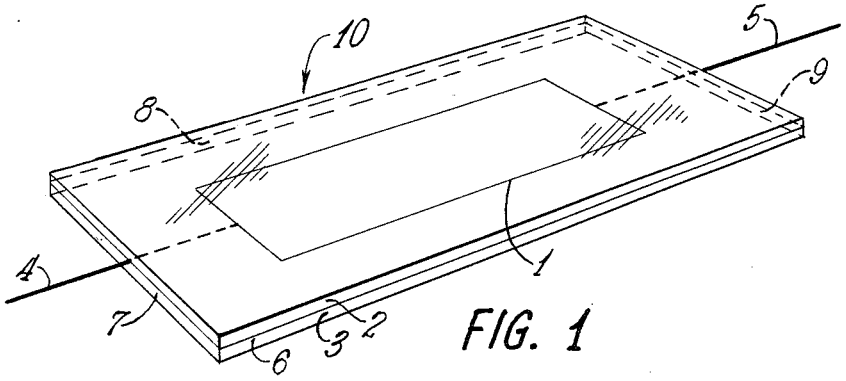
FIG. 1 is a depiction in isometric of one embodiment of the invention.

Any suitable polymer can be used in this invention. Such polymers are usually conjugated polymers, or mixtures thereof, dopable to an electrically conducting state. Such polymers are known in the art, and include, for example, acetylene polymers such as cis-and trans-polyacetylenes, poly (p-phenylene), poly (m-phenylene), poly (phenylene sulfide), polyphenylacetylene, polypyrrole, polythiophene, and the like, and mixtures thereof. Acetylene polymers are the preferred materials.

The polymers can be employed in any suitable form as, for example, powders, foams, films, fibers, compressed powders and compressed films. Films are the preferred form for use in the present invention.

The polymers can be doped with any suitable dopant and in any suitable manner. Suitable dopants and dopant procedures are those described in U.S. Pat. Nos. 4,204,216 and 4,222,903 to Heeger et. al. and 4,321,114 to MacDiarmed et. al. In general, the dopant will be one in which the anionic dopant species is one, or more, selected from the group consisting of halide ions, $ClO_4^-$, $PF_6^-$, $As^-F_4^-$, $SO_3CF_3^-$ and $BF_4^-$, and mixtures thereof, alkali metals such as sodium and sodium-potassium mixtures and other materials such as bromine, iodine, iodine chloride, iodine bromide, arsenic pentafluoride, molybdenum pentachloride, transition metal carboxyl, phosphene, and olefin derivatives. These dopants can be included in a carrier, or solvent, such as dry methylene chloride and the like.

The preferred dopant employable in this invention is a 2 weight percent solution of molybdenum pentachloride in dry methylene chloride solvent.

Any suitable method of doping the polymeric material can be employed, including immersion with, or without, the use of a solvent. In the preferred method of carrying out the invention, the polymer, in film form, having a thickness of from about 0.05 to about 0.15 mm, is immersed in the methylene chloride solution containing the molybdenum pentachloride for a period of about four minutes, after which the polymeric film is removed from the solution, washed and dried.

Any suitable encasement material, in any planular form, can be employed. Suitable forms include substantially flat members placed in substantially contact relationship with the polymeric material positioned therebetween. Suitable materials include polystyrene, polymethylmethacrylate, polycarbonates, glass, glass-like materials such as diamond, mica, and the like, which materials are substantially impermiable from the standpoint of dopant escaping from within the encasement or gases penetrating into the encasement. Such material can be of any size and shape having substantially planular, matching surfaces.

In the preferred embodiment of this invention, the encasing materials are glass ribbons in the form of films about 0.005 cm thick and about 1 cm in width with the doped polymeric material positioned therebetween.

The doped polymeric material or materials can be positioned in continuous lengths in one or more similar or dissimilar rows, the rows being held apart by the pressure of the ribbons or by compartmentalizing the substrates. Any suitable connections, or terminals, can be used to extend from contact with the polymeric material to the outside of the encasement. The encasement can be sealed along its edges in any suitable manner to provide a suitable leak-proof enclosure.

The encasement with the polymeric material positioned therein, and the electrical conductors extending outwardly therefrom can be filled with an inert gas in any suitable manner. Preferably, the encasement will be filled with the inert gas to an absolute pressure of from about 755 to about 765 mm Hg. After an evacuation to rid the sample of solvents after the doping step, the encasement can be filled with nitrogen.

Referring now to FIG. 1, there is shown the doped polymeric material 1 positioned between two planular, essentially electrically non-conducting surfaces 2 and 3 with conductors 4 and 5 extending outwardly to the exterior of the encasement 10. The encasement is sealed around its edges 6, 7, 8 and 9 to form a substantially leak-proof conductor.

Figure 3:
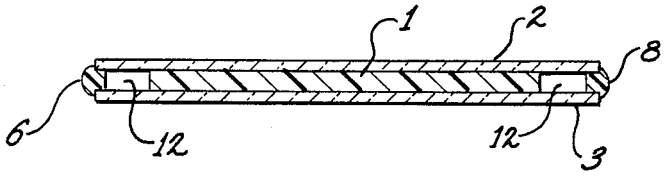
FIG. 3 is a cross sectional view of FIG. 1.

Referring now to FIG. 3, there is shown the polymeric material 1 between the planular surfaces 2 and 3. The edges are sealed, and the space 12 defined by the edge of the polymeric material 1 and the matching planular surfaces 2 and 3 is filled with an inert gas.

Figure 2:
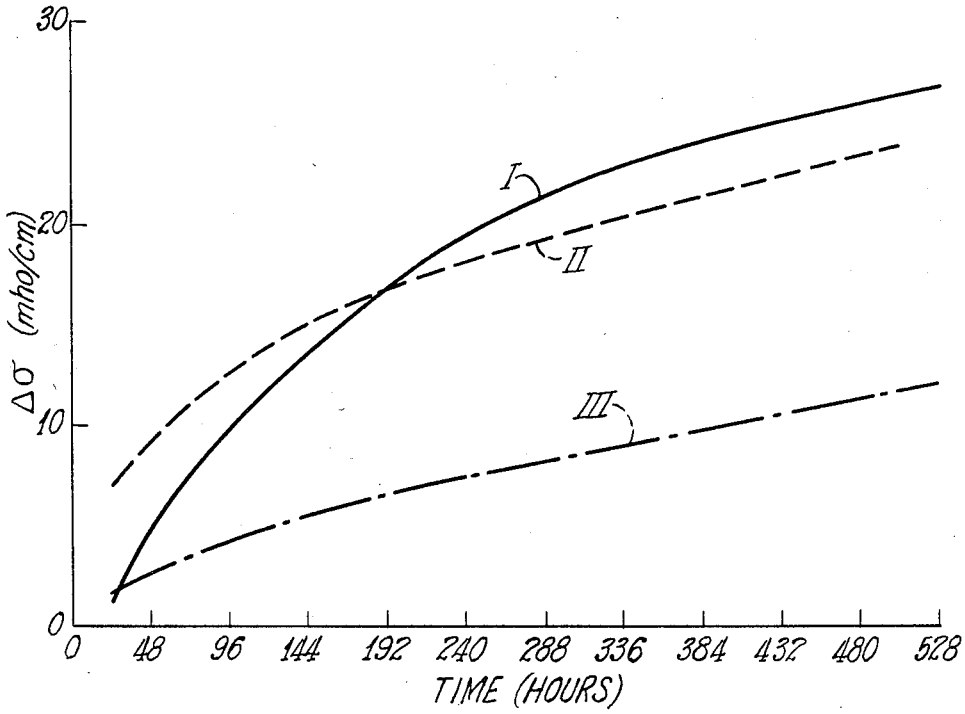
FIG. 2 is a comparison of the electrical conductive degradation of the doped polymer of this invention to that of similar polymers with or without other encasements.

Referring now to FIG. 2, there is shown a plot of the conductivity of polymeric conductors in terms of (mho/cm) versus time in hours. In effect, FIG. 2 shows the degradation in conductivity of a non-encased polymeric strip (Curve I) in an inert gas as compared to a polymeric strip enclosed in a glass tube (Curve II) filled with an inert gas and a polymer strip enclosed in substantially contacting glass ribbons (Curve III). Original pressures within the glass tube and glass ribbon were substantially identical. However, the degradation in electrical conductivity at intervals over a period of 528 hours, as measured at 48 hour intervals, is considerably less for the glass ribbon encased polymeric material than for the glass tube encased polymeric material, that is, approximately 9.7 mho/cm per 528 hour period for the ribbon encasement as compared to 16.5 mho/cm 528 hour period for the glass tube encasement or a comparative rate of 170% greater for the glass tube encasement than for the ribbon encasement.

It will be evident from the foregoing that various modifications can be made to the method of this invention. Such, however, are considered within the scope of the invention.

We claim:

1. A method of producing an electrical conductor which comprises:

a. treating a polymeric material with a dopant to make the material electrically conductive;

b. locating said polymeric material in an encasment comprised of a pair of ribbon-like members having planar opposed matching surfaces, said encasement being substantially electrically non-conductive and substantially impermeable to said dopant, said polymeric material being positioned between the matching surfaces in contact with each of said surfaces effective to substantially reduce the loss of dopant from said polymeric material;

c. extending electrical conducting means in contact with said polymeric material to the exterior of the encasement;

d. filling any space between the matching surfaces not occupied by the polymeric material with an inert gas; and e. sealing said encasement around the edges thereof to retain said inert gas in said encasement.

2. The method of claim 1 wherein said encasement is selected from the group consisting of polymers, glass, diamond and mica.

3. The method of claim 1 in which said film is encased in glass ribbons about 0.005 cm in thickness.

4. The method of claim 1 in which said material is positioned in a plurality of rows within said encasement.

5. An electrical conductor comprising;

a. a polymeric material containing a dopant to make the material electrically conductive;

b. an encasement comprised of a pair of ribbon-like members having planar, opposed matching surfaces, said encasement being substantially electrically non-conductive and substantially impermeable to said dopant, said polymeric material being positioned between the matching surfaces in contact with each of said surfaces effective to substantially reduce the loss of dopant from said polymeric material;

c. electrical conductor means in contact with the polymeric material and extending to the exterior of the encasement; and d. an inert gas to fill any space between the matching surfaces not occupied by the polymeric material, said encasement being sealed around the edges thereof to retain said inert gas in said encasement.

6. The conductor of claim 5 in which said encasement material is selected from the group consisting of polymers, glass, diamonds and mica.

7. The conductor of claim 5 in which said encasement is filled with an inert gas within the range of from about 755 to about 765 mm Hg, absolute.

8. The conductor of claim 5 in which said encasement comprises glass ribbons about 0.005 cm in thickness.

9. The conductor of claim 5 in which said a plurality of said materials are positioned within said encasement.

* * * * *